US005609269A

United States Patent [19]

Behnke et al.

[11] Patent Number: 5,609,269

[45] Date of Patent: Mar. 11, 1997

[54] ROLLED TISSUE PRODUCTS CONTAINING DISCRETE OVERLAPPED TISSUE SHEETS

[75] Inventors: Janica S. Behnke, Appleton; Scott A. Baum, Fremont; Rodney L. Abba, Oshkosh, all of Wis.

[73] Assignee: Kimberly-Clark Corporation, Neenah, Wis.

[21] Appl. No.: 291,806

[22] Filed: Aug. 17, 1994

[51] Int. Cl.[6] ..... A47K 10/24

[52] U.S. Cl. ..... 221/48; 206/494

[58] Field of Search ..... 221/47, 48, 63, 221/33, 44, 46; 206/210, 409, 494

[56] References Cited

U.S. PATENT DOCUMENTS

| | | | |
|---|---|---|---|
| 4,171,047 | 10/1979 | Doyle et al. | 221/63 |
| 4,865,221 | 9/1989 | Jackson et al. | 221/48 |
| 4,905,868 | 3/1990 | Beane et al. | 221/44 |
| 5,135,134 | 8/1992 | Daney | 221/63 |
| 5,246,137 | 9/1993 | Schutz et al. | 221/44 |
| 5,332,118 | 7/1994 | Muckenfuhs | 221/48 |

FOREIGN PATENT DOCUMENTS

| | | | |
|---|---|---|---|
| 0243906 | 11/1987 | European Pat. Off. | B65B 27/08 |
| 0364896 | 4/1990 | European Pat. Off. . | |
| 2725547 | 12/1978 | Germany | B65H 29/66 |
| 2909831 | 1/1980 | Germany | B65H 29/66 |
| 3330485 | 3/1984 | Germany . | |

*Primary Examiner*—Kenneth Noland

[57] ABSTRACT

A tissue product and method are disclosed in which individual discrete tissue sheets which overlap each other are wound into a roll. The overlapping provides a means for pop-up, one-at-a-time tissue dispensing. Preferably, the sheets are dispensed axially from a coreless roll. The overlapping sheets within the roll can be interleaved as well as overlapped to increase the frictional engagement between successive sheets. This product form is useful for a variety of tissue products, such as facial tissue, bath tissue, kitchen towels and napkins.

45 Claims, 5 Drawing Sheets

ROLLED TISSUE PRODUCTS CONTAINING DISCRETE OVERLAPPED TISSUE SHEETS

BACKGROUND OF THE INVENTION

Household tissue products, such as facial tissue, bath tissue, kitchen towels and napkins, are available in two basic product forms. One product form is a continuous roll, which is commonly used for bath tissue and kitchen towels. The individual sheets within the roll are separated by a line of perforations which must be torn as the sheet is removed from the roll. Oftentimes the perforation lines do not tear cleanly, resulting in ripped sheets and ragged edges.

The other product form is a stack of individual sheets as is commonly used for facial tissue and dinner napkins. The tissues or napkins can be interfolded for pop-up dispensing or they can be simply laid one on top of the other. The stacked product form usually dispenses very well, but a flat-stacked product has limitations with respect to the size of the "footprint" of the box in which the tissues are stacked. Inherently, stacked tissues require a relatively high package volume for a given number of sheets as compared to the roll product form. Also, in an effort to reduce the size of the dispensing carton, facial tissues and dinner napkins are always dispensed in a folded configuration, which requires the user to unfold the dispensed tissue prior to use.

Hence there is a need for different tissue product forms that overcome these deficiencies and provide the consumer with alternative choices.

SUMMARY OF THE INVENTION

It has now been discovered that a variety of tissue products can be provided in a roll of separate individual or discrete sheets, which can be folded or unfolded, and dispensed one-at-a-time. Advantageously, the roll of individual sheets can be a coreless roll which dispenses the tissues from the center of the roll in the axial direction. This invention provides an alternative product form for products typically dispensed in folded form, such as facial tissues and napkins, and eliminates some disadvantages associated with perforated roll products.

Hence in one aspect, the invention resides in a tissue product comprising a roll of multiple, discrete, consecutive tissue sheets which overlap each other in the circumferential direction of the roll. The roll can be coreless for axial or circumferential dispensing, or it can be cored for circumferential dispensing. The roll of discrete sheets can be contained within any suitable dispensing carton which permits removal of the individual sheets, or the roll may be used without a carton as is the case for conventional kitchen towels and bath tissue. As the individual sheets are dispensed, the sheet being withdrawn is in frictional engagement with the following sheet, causing the following sheet to "pop up" for subsequent withdrawal. The degree of overlap necessary to effectively dispense will depend on the surface characteristics of the particular sheets and the winding tension within the roll. In order to increase the frictional engagement, the sheets can be folded, overlapped and interleaved. For purposes herein, interleaving is a form of the broader concept of overlapping. Dispensing can be either axially from the center of the roll or circumferentially from the outer surface of the roll.

In another aspect, the invention resides in a method for making a tissue product comprising the steps of: (a) cutting a continuous sheet of tissue into discrete, consecutive sheets; (b) overlapping each sheet with the previous sheet; and (c) winding the overlapped sheets into a roll. The resulting roll of discrete, individual sheets can be placed in a carton for protection and/or for dispensing.

As used herein, a "tissue" sheet is a low density paper sheet useful for products such as facial tissue, bath tissue, paper kitchen towels, dinner napkins and the like. In the case of facial tissues, the discrete tissue sheets can be assembled into the roll in a variety of ways, as will be described in greater detail in connection with the Drawing. In the simplest form, for example, the sheets can be simply overlapped in an unfolded state. Alternatively, the sheets can be V-folded, C-folded, Z-folded or otherwise folded as desired and thereafter simply overlapped. Alternatively, the sheets can be overlapped and subsequently folded to provide an interleaved form of overlap to further increase frictional engagement.

In the case of napkins, which tend to be of a larger size than facial tissues, it is preferable that the individual napkins be folded into quadrants or otherwise as is common for such products, and thereafter simply overlapped and wound into the roll. Interleaving is also possible depending on the folding pattern. Either form of overlapping provides a unique pop-up dispensing product for dinner napkins.

In the case of tissue products that are conventionally made in roll form, such as kitchen towels and bath tissue, the individual sheets can be overlapped or interleaved, either folded or unfolded as desired. If a cored roll is used, the products of this invention can be used on conventional bath tissue or kitchen towel spindles. If a coreless roll is used, these products can be dispensed anywhere, such as counter tops or toilet covers as is the case with facial tissues.

The extent of sheet overlap in all cases will depend on the characteristics of the individual sheets, winding tension, the roll size and the dispensing attribute desired. Factors such as embossing, layering, furnish, composition, calendering, etc. all affect the sheet characteristics. Particularly for the coreless roll, the extent of sheet overlap can be intentionally varied within the roll in order to maintain proper dispensing throughout the roll by taking into account the relatively small, tight space in the center of a fresh roll, compared to the larger airspace present after most of the roll has been dispensed. In some cases, the degree of overlap will be greater at the periphery of the fresh roll than it is towards the center of the roll. In other cases, however, the centermost sheet will have a higher degree of overlap. Numerically, the amount of sheet overlap will be at least about ⅛ inch or greater, more specifically about 1 inch or greater, still more specifically about 2 inches or greater. If the extent of overlap becomes too great, multiple sheet dispensing occurs.

DETAILED DESCRIPTION OF THE DRAWING

Figure 1:
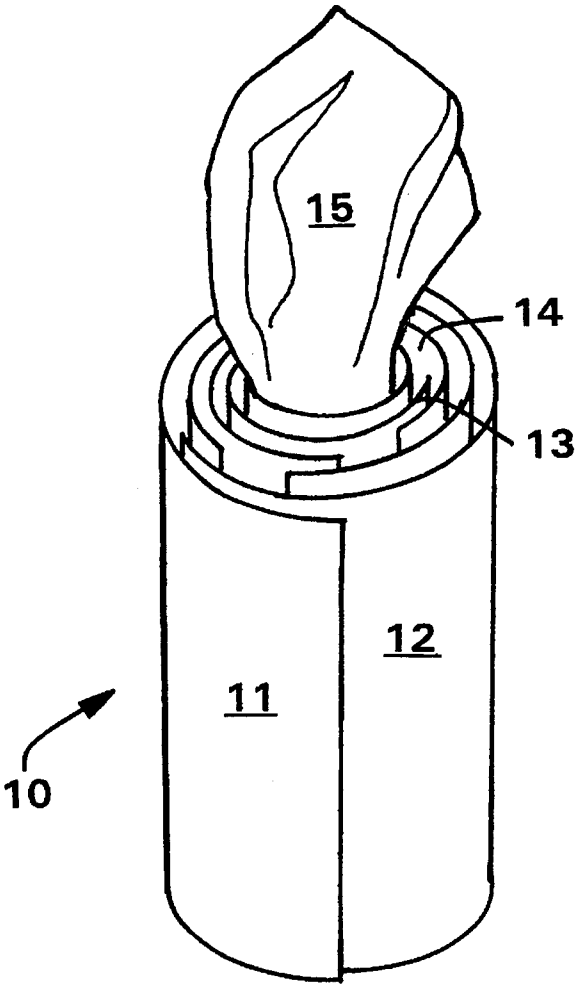
FIG. 1 is a perspective view of a wound coreless roll of discrete sheets in accordance with this invention, illustrating pop-up axial dispensing of the sheets from the center of the roll.

Referring to FIG. 1, a schematic perspective view of a tissue product made in accordance with the present invention containing discrete overlapped sheets is shown. Outer sheets 11 and 12 are referenced, as well as sheets 13, 14 and 15. Additional sheets comprising the body of the roll are not numbered. The total number of sheets in the roll would be equal to the desired sheet count for the bath, facial, towel or napkin product. Inner sheets 13 and 14 are kept in place by the roll integrity for pop-up dispensing, since this particular execution is that of a coreless roll with axial center dispensing. Sheet 15 is shown partially removed from the roll 10 in a condition that would generally occur after dispensing the previous sheet. Such sheets have a partially-curved, neater appearance as compared to conventional multifolded products. In dispensing, sheet 15 is pulled outward from roll 10. The overlapping of sheet 15 with sheet 14 causes sheet 14 to follow sheet 15 partially from roll 10 until there is no longer adequate pressure and contact between the sheets, at which time sheet 14 will no longer move with sheet 15, leaving it in position for the next use.

Figure 2:
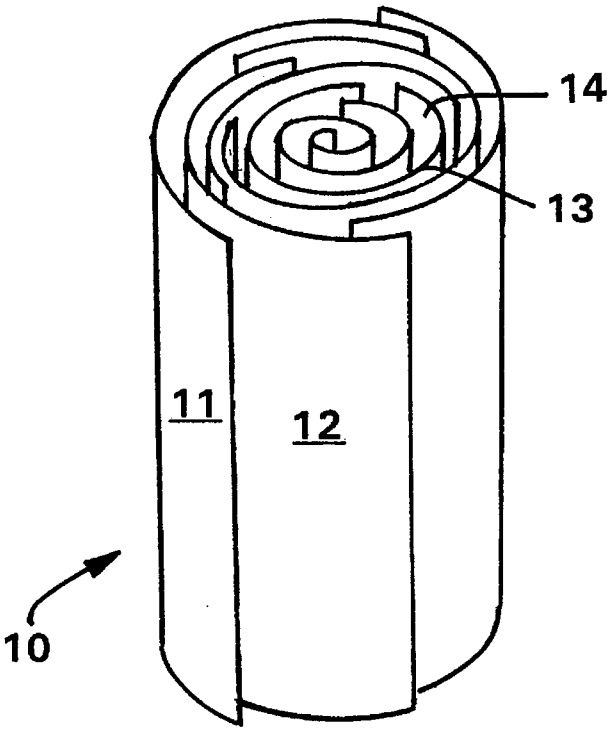
FIG. 2 is a perspective view of a wound coreless roll as shown in FIG. 1, without illustrating axial withdrawal of the sheets.

FIG. 2 shows roll 10 as it would look prior to placing it within suitable packaging. The overlapping of the sheets can be varied, as will be described hereinafter, to tailor the dispensing characteristics of the roll. For instance, in dispensing applications from the roll exterior where sheet 11 would be released first, an overlapping or interleaving configuration that locks the sheets together more is required. On the other hand, if sheet 14 is to be dispensed first, less interleaving is required.

Figure 3:
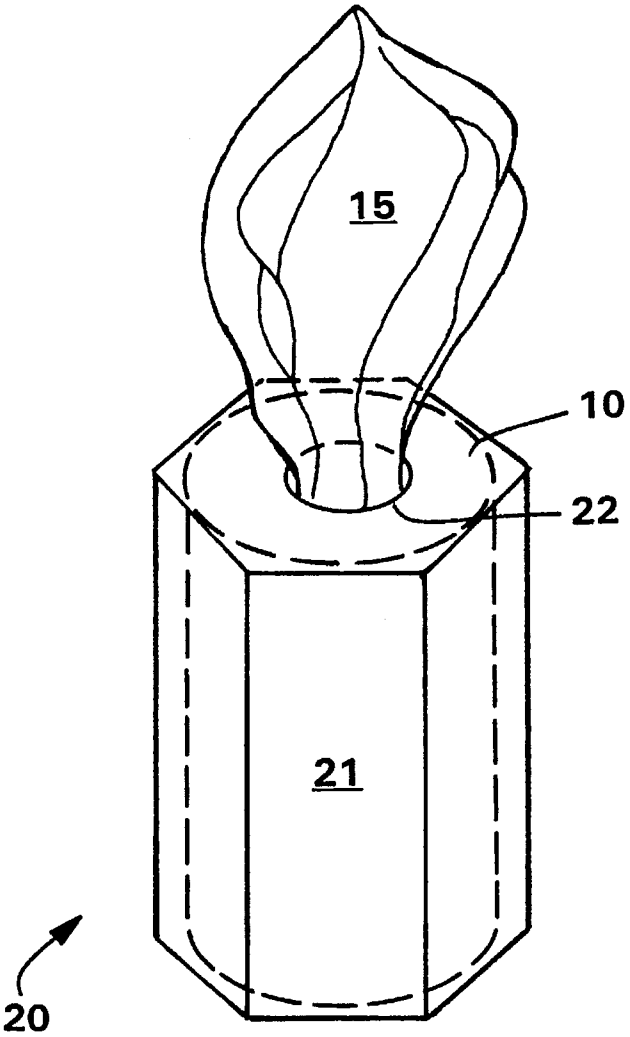
FIG. 3 is a perspective view of a dispensing carton containing the roll of FIG. 2, illustrating axial dispensing.

FIG. 3 portrays a tissue product 20 comprising a hexagonal dispensing carton 21 for roll 10 designed for axial dispensing of the tissues. Here roll 10 (depicted by dashed lines) has been placed into the hexagonal carton containing an end dispensing opening 22. The unique configuration of the wound overlapped sheets leaves the next tissue 15 "standing up." As a result, poly flaps and the like are not required to keep sheet 15 from falling back into roll 10. Such may be provided as a desirable sanitary feature, however. The unique configuration of the wound tissues also lends itself to many different carton shapes and sizes. Round, hexagonal, square or other geometric shapes can be used to provide aesthetically pleasing cartons for the consumer.

Figure 4:
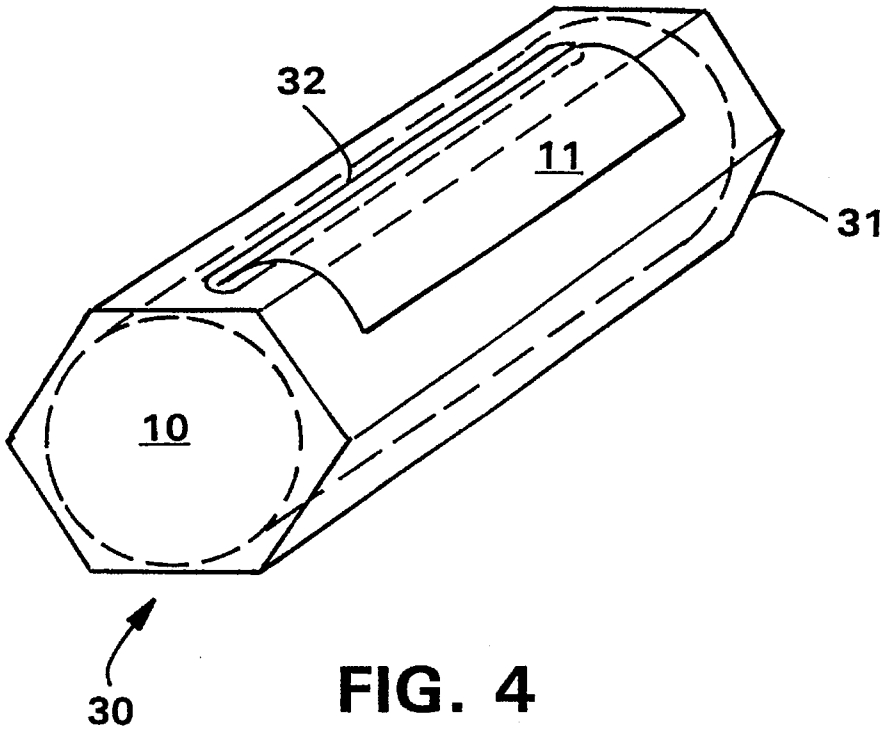
FIG. 4 is a perspective view of a dispensing carton containing the roll of FIG. 2, illustrating circumferential dispensing.

FIG. 4 shows a tissue product 30 for circumferential dispensing from the outside of roll 10. Hexagonal carton 31 is designed with slot 32 for dispensing of the sheets. Roll 10 can be coreless or wound on a core if desired for manufacturing reasons. As outer sheet 11 is pulled from slot 32, roll 10 will rotate within the carton due to the overlapping of the sheets within the roll. This allows the next sheet to travel partially through slot 32 until forces are no longer sufficient to cause it to travel further as sheet 11 is withdrawn.

Figure 5:
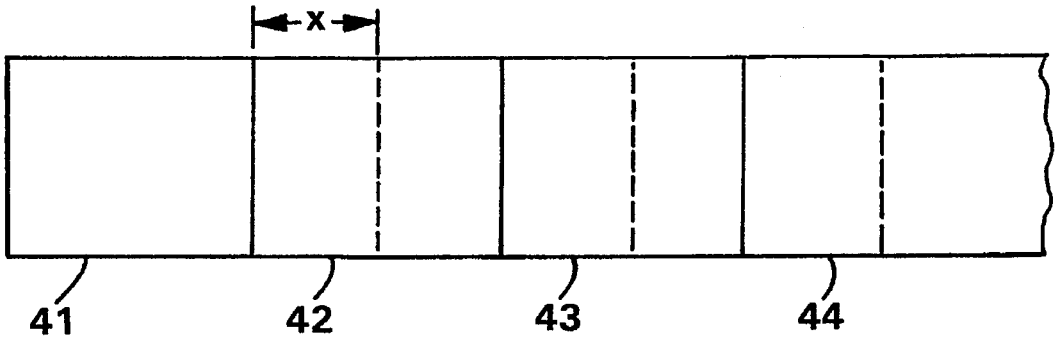
FIGS. 5 and 5A are a plan view and side view, respectively, of overlapped, distinct individual tissue sheets to be wound into a roll in accordance with this invention.
Figure 5A:
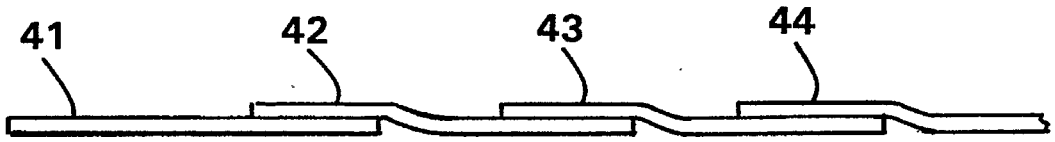

FIGS. 5 and 5A illustrate one embodiment of overlapping discrete consecutive tissue sheets in accordance with this invention. Shown are discrete tissue sheets 41, 42, 43 and 44. The sheets are overlapped by a distance "x" as shown. The hidden edges of the tissues are represented by dashed lines. The individual sheets can be unfolded flat sheets, or they can be folded in any configuration.

Figure 6:
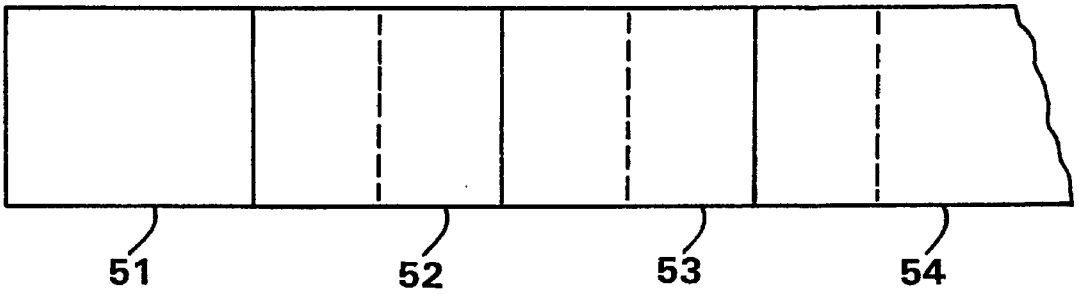
FIGS. 6 and 6A are a plan view and a side view, respectively, of V-folded tissue sheets which have been overlapped and interleaved in accordance with this invention.
Figure 6A:
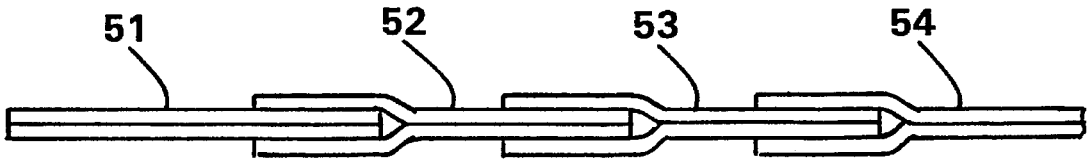

FIGS. 6 and 6A illustrate another embodiment of overlapping discrete consecutive sheets for use in accordance with this invention. In this embodiment, the individual tissue sheets 51, 52, 53 and 54 are not simply overlapped, but also interleaved. The individual sheets are V-folded, with one end of each consecutive sheet partially opened and folded around the end of the previous V-folded sheet.

Figure 7:
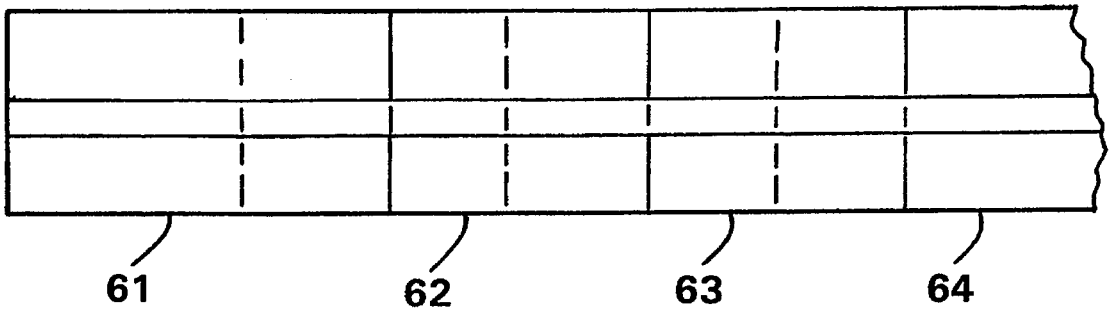
FIGS. 7 and 7A are a plan view and a side view, respectively, of C-folded tissue sheets which have been overlapped and interleaved in accordance with this invention.
Figure 7A:
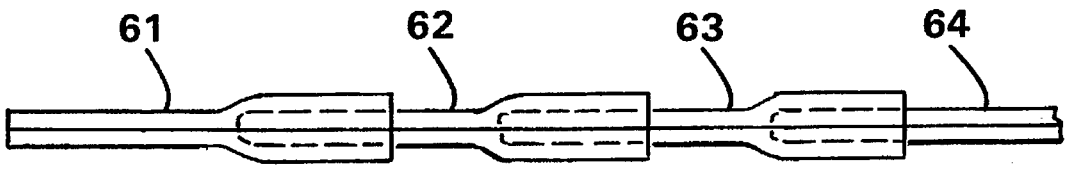

FIGS. 7 and 7A illustrate another method of overlapping discrete consecutive sheets for use in accordance with this invention. In this embodiment, the individual sheets 61, 62, 63 and 64 are C-folded sheets. Similar to the embodiment illustrated in FIG. 6A, the sheets are also interleaved with one end of each sheet being folded around the following sheet and the other end folded within the previous sheet.

Figure 8:
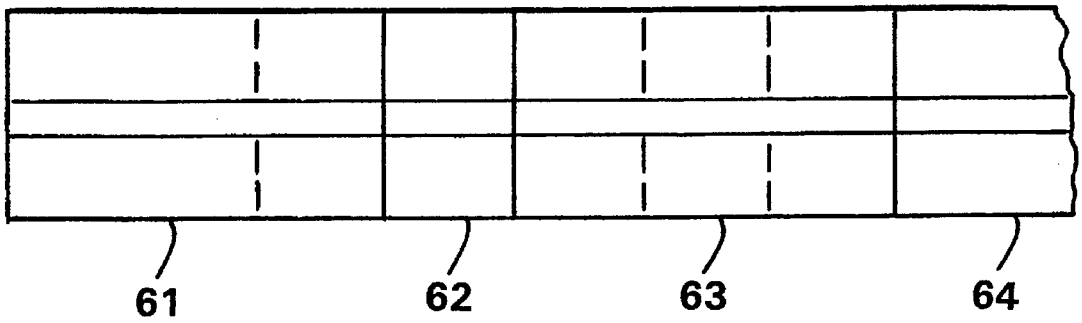
FIGS. 8 and 8A are a plan view and a side view, respectively, of C-folded tissue sheets similar to those of FIGS. 7 and 7A, which have been overlapped and interleaved in an alternating manner in accordance with this invention.
Figure 8A:
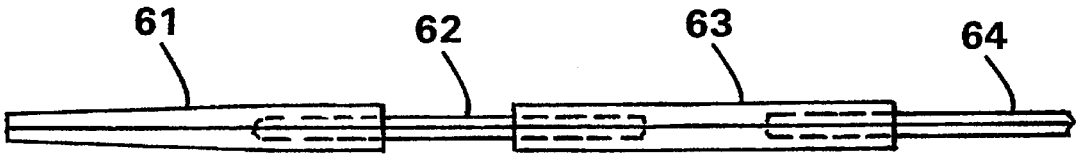

FIGS. 8 and 8A illustrate another method of overlapping discrete consecutive sheets 61, 62, 63 and 64 in which both ends of a given sheet interact with both the previous and following consecutive sheets in the same way. Specifically, both ends of sheet 62 are interleaved within the previous and subsequent sheets 61 and 63, respectively.

Figure 9:
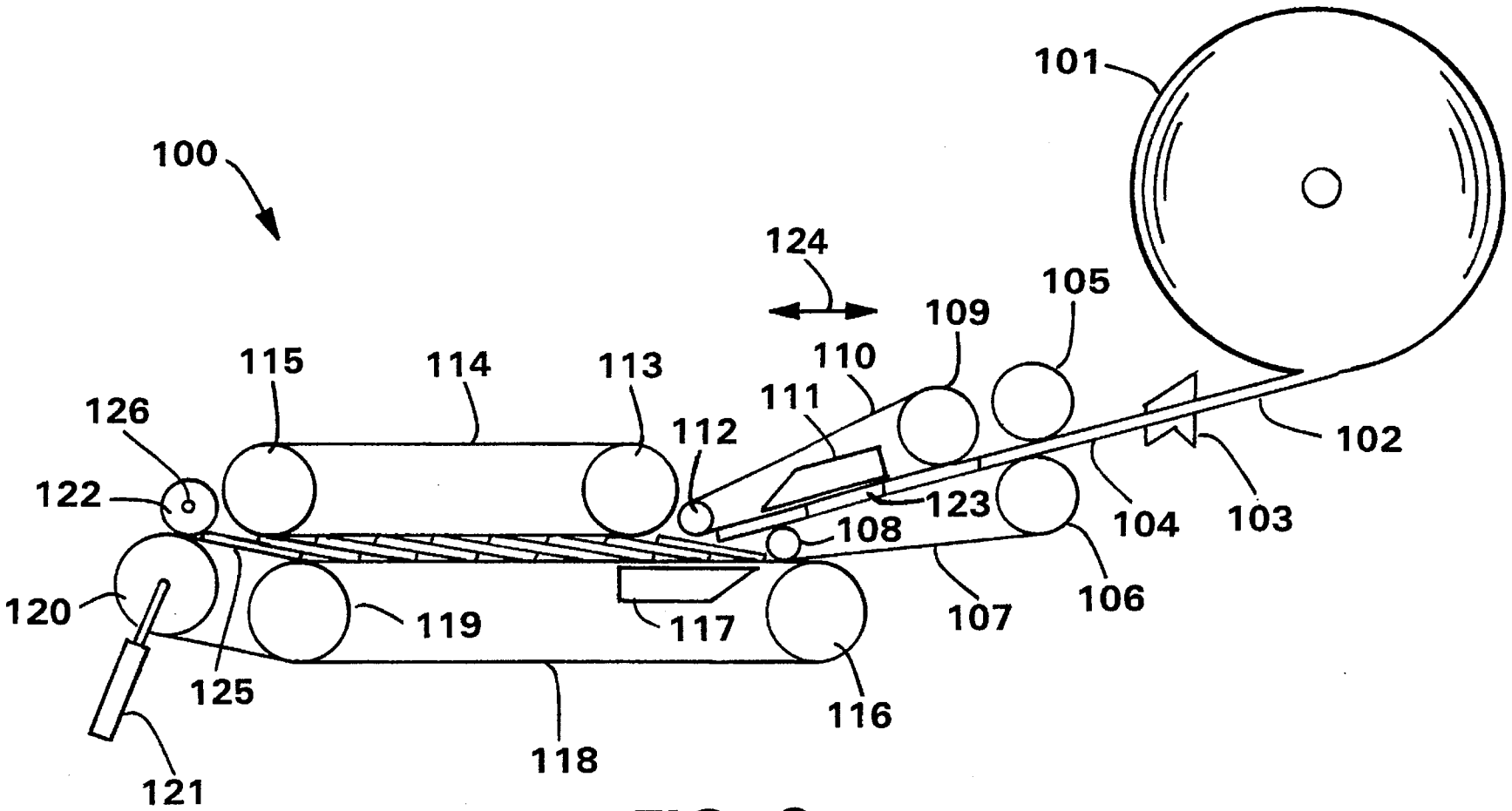
FIG. 9 is a schematic view of a method for producing wound, distinct tissue sheets in accordance with this invention.

FIG. 9 illustrates an overlapping winder 100 for the production of roll 10 comprising the following steps. Roll 101 which has been previously slit, and crimped if a multi-ply product, is unwound such that web 102 passes over folding board 103. Folding board 103 can be a "C", "V", or "Z" type folding board. Alternatively, if no fold is desired, folding board 103 may simply be removed from the web path. Folded web 104 is pulled into the nip between belt 107 and cut-off roller 105. The surface of roller 105 is made from a soft rubber material. This creates a good surface for pulling web 104 into the cut-off area and helps to crease the fold into web 104. Cut-off rollers 105 and 106 have a single knife imbedded in their outer surfaces. The circumference of these rollers is made equal to the desired length for the discrete sheet to be overlapped. Belt 107 has appropriately spaced slots for the knife on cut-off roller 106. Folded web 104, after passing cut-off rollers 105 and 106, is severed into a discrete sheet 123. Belts 110 and 107 contain sheet 123 after it has been severed. Idler pulleys 112 and 108 guide their respective belts. Vacuum box 111, in combination with holes in belt 110, assures sheet 123 will follow belt 110 after passing idler pulley 108 and not travel with belt 107 around the periphery of idler pulley 108. Transfer to belt 118 is accomplished by vacuum box 117. The degree of overlap between subsequent sheets can be altered by moving items 105-112 back and forth as indicated by arrow 124 relative to the forward part of overlapping winder 100 and varying the relative speeds between belt 110 and 118. The movement and relative speeds can be accomplished while the machine is winding to vary the overlap through the radius of roll 122. After transfer of sheet 123 to belt 118, the overlapped sheets are contained between belts 118 and belt 114. Belts 118 and 114 are guided by pulleys 113, 115, 116, 119, 120. The nip created between belts 118 and 114 not only keeps the overlapped sheets from flying loose during transport but also helps to increase the friction engagement between the overlapped sheets. After traversing the length of belt 114, sheet 125 is ready to be wound onto roll 122. Roll 122 is supported by mandrel 126 which has a lengthwise slot in it. For coreless products, the first overlapped sheet is placed into the slot to begin winding the roll. For product forms requiring a core, the core is placed on to the mandrel and the overlapped sheet is adhered to it by appropriate means. The winding roll 122 is controlled by roller 120 and pneumatic cylinder 121 in accordance with known winding principles. If a tighter wound roll is desired, a larger nip load is used which can be accomplished by increasing the pressure to cylinder 121. When the desired number of sheets have been wound onto roll 122, it is removed from mandrel 126 and the process is repeated for additional rolls.

EXAMPLES

Example 1

A tissue product of this invention was made by overlapping and winding individual (discrete) V-folded facial tissue sheets. Facial tissue sheets with dimensions of 8.5 inches×9 inches were folded in half to obtain dimensions of 4.25 inches×9 inches. Each V-folded sheet was laid down such that the long dimension of the tissue overlapped the previous sheet in the long dimension by 4 inches. The length of overlapped tissues was then rolled up (referring to FIG. 5A) by rotating the left edge of sheet 41 clockwise and continuing to turn and roll up the tissues. Ninety tissues were overlapped and rolled up. The wound roll of discrete overlapped tissues was then placed in a typical upright carton of measuring 4 ⅜ inches by 4 ¼ inches by 5 ¼ inches.

Dispensing was tested by pulling individual sheets through the opening on the upper surface of the carton. A failure of the sheet to follow the prior sheet through the carton opening was called a fall back. The first 88 sheets dispensed without fall back. The last two sheets did not follow the previous sheets through the opening but remained upright and near the opening and were thus easy to retrieve.

Example 2

A tissue product of this invention was made by overlapping 30 C-folded sheets (8.5 inches wide×9 inches long, unfolded). The C-folded tissue sheets had folded dimensions of 4.5 inches×9 inches. The first sheet was laid down and overlapped by a second sheet for a length of 4-½ inches. The third tissue overlapped the second by 2-½ inches as did all subsequent tissues. All tissues were laid down on a conveyer belt. The leading end of the first tissue was inserted into a mandrel which rotated to wind up the overlapped tissues as the conveyer belt moved the tissues toward the mandrel. The diameter of the mandrel was 1-½ inches. The nip formed between the mandrel and the belt was controlled to provide a nip load of about 1 pound per lineal inch (pli). The resulting tissue product had a diameter of 2-½ inches and was removed from the mandrel, resulting in a coreless roll. Because the tissue product was wound under pressure, the interior sheets relaxed to fill the void left by the mandrel and this made the initial dispensing easier. Only one fall back occurred in each of two dispensing tests.

It will be appreciated that the foregoing examples, given for purposes of illustration, are not to be construed as limiting the scope of this invention, which is defined by the following claims and all equivalents thereto.

We claim:

1. A tissue product comprising a coreless roll of multiple, discrete consecutive tissue sheets which overlap each other in the circumferential direction of the roll such that opposite edges of the sheets in sum total define the opposite ends of the roll, wherein the sheets can be dispensed from within the center of the roll in the axial direction such that removal of one sheet partially removes the next consecutive sheet in a "pop-up" fashion.

2. The product of claim 1 wherein the tissue sheets are interleaved.

3. The product of claim 1 wherein the roll is coreless.

4. The product of claim 1 wherein the tissue sheets are overlapped by at least about ⅛ inch.

5. The product of claim 1 wherein the tissue sheets are overlapped by at least about 1 inch.

6. The product of claim 1 wherein the tissue sheets are overlapped by at least about 2 inches.

7. The product of claim 1 wherein the tissue sheets are overlapped by about 4 inches.

8. The product of claim 1 wherein the tissue sheets are overlapped by about one-half the length of a tissue sheet.

9. The product of claim 1 wherein the extent of overlap differs within the roll.

10. The product of claim 1 wherein the extent of overlap is substantially the same within the roll.

11. The product of claim 1 wherein the distance the sheets near the center of the roll are overlapped is less than the distance the sheets near the periphery of the roll are overlapped.

12. The product of claim 1 wherein the tissue sheets are not folded.

13. The product of claim 1 wherein the tissue sheets are single plies.

14. The product of claim 1 wherein the tissue sheets are multiple plies.

15. The product of claim 1 wherein the tissue sheets are C-folded and overlapped.

16. The product of claim 1 wherein the tissue sheets are C-folded and interleaved.

17. The product of claim 1 wherein the tissue sheets are V-folded and overlapped.

18. The product of claim 1 wherein the tissue sheets are V-folded and interleaved.

19. The product of claim 1 wherein the tissue sheets are folded napkins.

20. The product of claim 1 wherein the tissue sheets are kitchen towels.

21. The product of claim 1 wherein the tissue sheets are facial tissues.

22. The product of claim 1 wherein the tissue sheets are bath tissues.

23. The tissue product of claim 1 enclosed within a dispensing carton having a dispensing opening at one end for axial pop-up dispensing of the tissue sheets.

24. A tissue product comprising a dispensing carton containing a roll of multiple, discrete, consecutive tissue sheets which overlap each other in the circumferential direction of the roll such that opposite edges of the sheets in sum total define the opposite ends of the roll wherein the dispensing carton contains an opening through which the individual sheets are circumferentially dispensed such that removal of one sheet partially removes the next consecutive sheet within the roll.

25. The tissue product of claim 24 having a core within the roll.

26. The tissue product of claim 24 wherein the roll is coreless.

27. The product of claim 24 wherein the tissue sheets are overlapped by at least about ⅛ inch.

28. The product of claim 24 wherein the tissue sheets are overlapped by at least about 1 inch.

29. The product of claim 24 wherein the tissue sheets are overlapped by at least about 1 inch.

30. The product of claim 24 wherein the tissue sheets are overlapped by about 4 inches.

31. The product of claim 24 wherein the tissue sheets are overlapped by about one-half the length of a tissue sheet.

32. The product of claim 24 wherein the extent of overlap differs within the roll.

33. The product of claim 24 wherein the extent of overlap is substantially the same within the roll.

34. The product of claim 24 wherein the distance the sheets near the center of the roll are overlapped is less than the distance the sheets near the periphery of the roll are overlapped.

35. The product of claim 24 wherein the tissue sheets are not folded.

36. The product of claim 24 wherein the tissue sheets are single plies.

37. The product of claim 24 wherein the tissue sheets are multiple plies.

38. The product of claim 24 wherein the tissue sheets are C-folded and overlapped.

39. The product of claim 24 wherein the tissue sheets are C-folded and interleaved.

40. The product of claim 24 wherein the tissue sheets are V-folded and overlapped.

41. The product of claim 24 wherein the tissue sheets are V-folded and interleaved.

42. The product of claim 24 wherein the tissue sheets are folded napkins.

43. The product of claim 24 wherein the tissue sheets are kitchen towels.

44. The product of claim 24 wherein the tissue sheets are facial tissues.

45. The product of claim 24 wherein the tissue sheets are bath tissues.

* * * * *